US008851983B2

(12) United States Patent
Herrmann

(10) Patent No.: US 8,851,983 B2
(45) Date of Patent: Oct. 7, 2014

(54) SYSTEM AND METHOD FOR INSURING CASINO OPERATORS AGAINST IMPROBABLE GAMING OUTCOMES

(75) Inventor: Mark E. Herrmann, Wellesley, MA (US)

(73) Assignee: Scientific Games Holdings Limited, Ballymahon, Co. Longford (IE)

( * ) Notice: Subject to any disclaimer, the term of this patent is extended or adjusted under 35 U.S.C. 154(b) by 388 days.

(21) Appl. No.: 12/841,582

(22) Filed: Jul. 22, 2010

(65) Prior Publication Data

US 2011/0065499 A1 Mar. 17, 2011

Related U.S. Application Data

(60) Provisional application No. 61/227,510, filed on Jul. 22, 2009.

(51) Int. Cl.
*G07F 17/32* (2006.01)

(52) U.S. Cl.
CPC ..... *G07F 17/3244* (2013.01); *G07F 17/32* (2013.01)
USPC ..... 463/29; 463/16; 463/17; 463/42

(58) Field of Classification Search
USPC ..... 463/29, 16, 17, 42
See application file for complete search history.

(56) References Cited

U.S. PATENT DOCUMENTS

| | | | | |
|---|---|---|---|---|
| 8,512,146 | B2 * | 8/2013 | Gururajan et al. | 463/42 |
| 2006/0199631 | A1 * | 9/2006 | McGill et al. | 463/16 |
| 2006/0217176 | A1 * | 9/2006 | Walker et al. | 463/16 |
| 2007/0129141 | A1 * | 6/2007 | Walker et al. | 463/25 |
| 2007/0155465 | A1 * | 7/2007 | Walker et al. | 463/16 |
| 2012/0046111 | A1 * | 2/2012 | Walker et al. | 463/42 |

* cited by examiner

*Primary Examiner* — Pierre E Elisca
(74) *Attorney, Agent, or Firm* — Dority & Manning, P.A.

(57) ABSTRACT

Aspects and embodiments of the present invention are directed generally to systems and methods for providing gaming insurance to casino operators by aggregating historical gaming results over an electronic medium or network of qualified casino patrons who choose to participate in one or more gambling loyalty programs and modeling those players against available games within a specific property to predict future gross gaming revenue so an insurance contract can be structured to protect against statistical variances in the gross gaming revenues.

13 Claims, 3 Drawing Sheets

SYSTEM AND METHOD FOR INSURING CASINO OPERATORS AGAINST IMPROBABLE GAMING OUTCOMES

RELATED APPLICATIONS

This application claims priority under 35 U.S.C. §119(e) to U.S. Provisional Application Ser. No. 61/227,510, entitled "SYSTEM AND METHOD FOR INSURING CASINO OPERATORS AGAINST IMPROBABLE GAMING OUTCOMES," filed on Jul. 22, 2009, which is herein incorporated by reference in its entirety.

BACKGROUND OF INVENTION

Aspects of the present invention relate to casino risk management, and tracking of casino players and the wagers players make within a regulated gaming environment.

SUMMARY OF INVENTION

Aspects and embodiments of the present invention are directed generally to systems and methods for providing gaming insurance to casino operators by aggregating historical gaming results over an electronic medium or network of qualified casino patrons who choose to participate in one or more gambling loyalty programs and modeling those players against available games within a specific property to predict future gross gaming revenue so an insurance contract can be structured to protect against statistical variances in the gross gaming revenues.

In accordance with a first embodiment, there is provided a method of accessing and analyzing one or more qualified casino player records over an electronic medium. The method comprises securely logging into one or more casino management systems, extracting patron information from the one or more casino management systems to a remote system for analysis, analyzing patron play behavior and modeling it against known games, odds and rule sets, predicting a theoretical gross gaming revenue for each of the patrons and for casino operators associated with the one or more casino management systems for a specified period of time.

In accordance with some aspects of the method, the casino player records are associated with patrons who are members of a gambling loyalty program and/or are tracked by a casino/patron management system.

In accordance with some aspects of the method, the patron information includes at least one of frequency of visitation, games played, house advantage for those games played, bet size, duration of play, and pace of game play. The patron information may be augmented by information from third party databases, including information from credit scoring agencies, to provide a more complete picture of each patron.

In accordance with some aspects of the method, the method further comprises offering a casino operator an insurance contract guaranteeing a minimum return. Terms of the insurance contract may be based at least in part upon theoretical gross gaming revenue for qualified patrons at a casino. The theoretical gross gaming revenue may be calculated in part based upon an expected play volume for the qualified patrons.

In accordance with some aspects of the method, the method further comprises collecting premium fees from the casino operator and compensating the casino operator for valid claims against their insurance contract.

In accordance with another embodiment, there is provided an insurance system for insuring casino operators against improbable gaming outcomes. The system comprises a computerized casino management system adapted to gather information related to game play within a casino, an insurance system interface adapted to receive a request for a level of profitability insurance for a given time period in which the casino is operating, a network configured to transmit information from the casino management system to an insurer network, a network configured to transmit information from the insurance system interface to the insurer network, a risk determination engine included within the insurer network and configured to calculate statistics related to an expected profit return of the casino, and a premium calculation engine adapted to calculate a premium for the level of profitability and time period requested, based at least in part from the information transmitted from the casino management system.

In accordance with another embodiment, there is provided a method for insuring casino operators against improbable gaming outcomes. The method comprises gathering information related to game play within a casino on a computerized casino management system, entering a request for a level of profitability insurance for a given time period in which the casino is operating into an insurance system interface, transmitting information from the casino management system to an insurer network, transmitting information from the insurance system interface to the insurer network, calculating statistics related to an expected profit return of the casino on a risk determination engine included within the insurer network, and calculating a premium for the level of profitability and time period requested, based at least in part from the information transmitted from the casino management system on a premium calculation engine.

In accordance with some aspects, the method further comprises communicating a calculated insurance premium to the casino. The method may further comprise accepting payment of the insurance premium though a payment interface coupled to the insurer network.

In accordance with some aspects, the method further comprises transferring funds to the casino under the condition that the casino does not attain a level of profitability during the given time period requested in the request for a level of profitability insurance.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
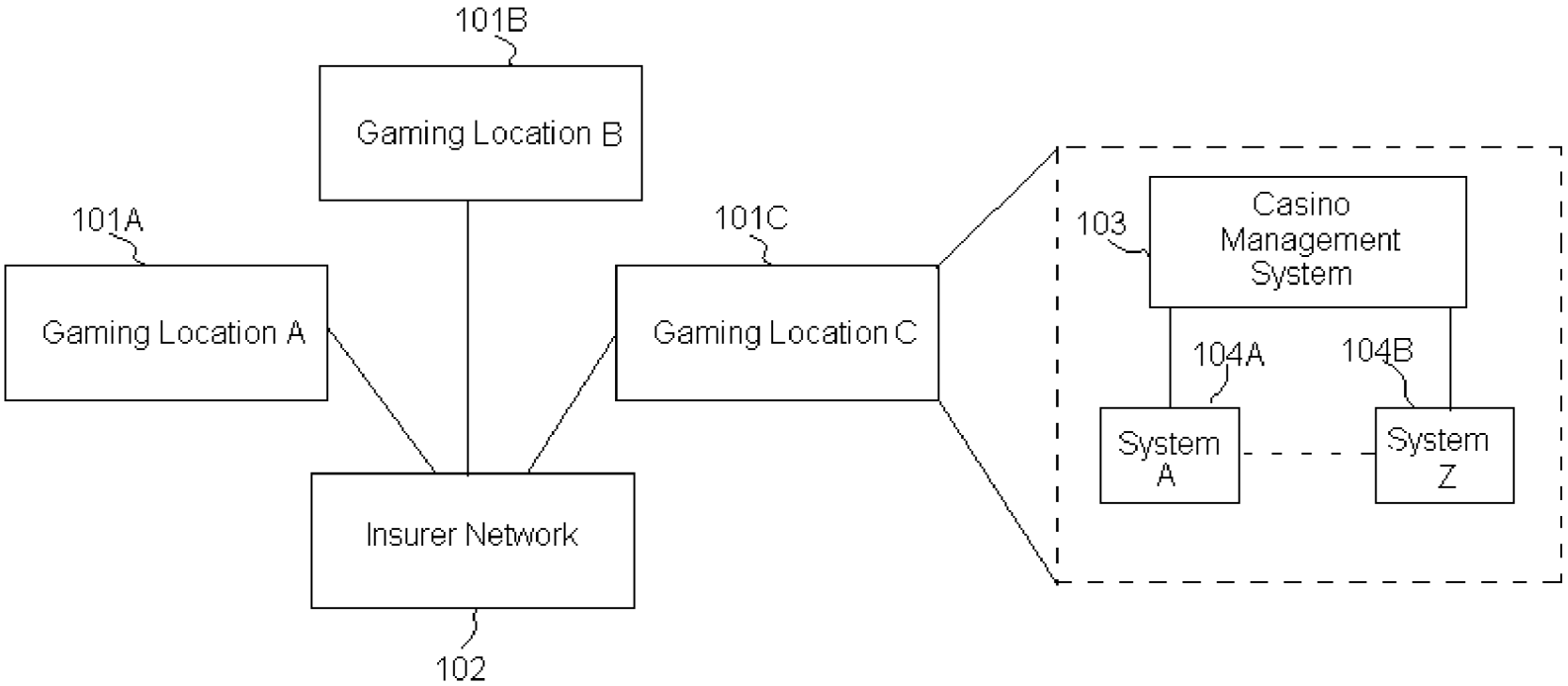
FIG. 1 is a block diagram of a system for managing casino operator risk in accordance with an aspect of the present invention.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," "having," "containing," "involving," and variations thereof herein is meant to encompass the items listed thereafter and equivalents thereof as well as additional items.

At its core the business of casino gaming is very simple. Casino operators generate revenue on their games because the mathematical probabilities behind their games favor the operator and not the player. The more bets or wagers a casino accepts, the more money it should theoretically make, given the favorable odds and the law of large numbers. If managed correctly, the casino operator always wins—in the long run.

Simply put, casino operators are not gambling. Instead, they rely on mathematical principles to assure that their regulated gaming establishment generates positive gross gaming revenues. In addition to generating positive gross gaming revenues, the casino operator must assure that the gaming revenues are also sufficient to cover general operating and marketing expenses, taxes, interest, allowances for bad debt as well as the inherent volatility in the mathematical statistics that govern their business. If the odds of the underlying games are set incorrectly given the expenses listed above, owning a casino operation can quickly become a losing proposition.

To understand how gaming insurance could play a vital role in making revenues more predictable and less volatile, one must first understand the concept of the casino's "house advantage" and then the importance of the underwriting discipline in the insurance industry.

All casino games, from the player perspective, are negative expectation games. Meaning, a player can expect to lose money playing the game over the long run. Simply stated, on average, the expected value of future winnings is less than zero. The rate and degree by which players lose depends on the rules of the game (bet limits, ability to play multiple hands, etc.), the underlying odds of the game and, in some cases where games allow players to make decisions, on the skill of the player. It is important to note that the house advantage represents the long run percentage of the wagered money that will be retained by the casino.

The total house advantage is the weighted average of the odds of all of the various bets being made on the casino floor for a given period of time. This is an abstract statistic, as the real number will almost certainly deviate from the expected value due to the "luck" of the casino, the skill level of the players participating, and the size of their wagers.

This variance or deviation from the expected value is known as the casino operator's risk exposure. Casino operators use advanced Gaussian statistical techniques to quantify this risk (e.g., they employ a statistical measure called the standard deviation coupled with the central limit theorem which tells them their expected house advantage). They also employ risk management techniques like table bet limits, game rules and hold percentages to reduce the risk premium they face. It is in the casino operator's interest to have smooth, predictable revenue streams, so lowering the volatility is paramount in order to run an efficient gaming operation.

Insurance underwriters, like casinos operators, prefer risks that they can properly evaluate. They typically accept only those risks that they are able to quantify with a high degree of certainty (e.g., most if not all information is known about the risk and it can be properly modeled using the same Gaussian statistical techniques including stress testing to include low probability loss scenarios known as fat tail events). By following strict underwriting standards, the insurer can reasonably set premiums that for all intents and purses, guarantee a positive rate of return on their underwriting activities.

If done correctly, writing gaming insurance should be a very profitable endeavor. First, patron play behavior, game odds, and house advantage is known for each property. Second, if the insurer is writing insurance contracts across a wide number of properties which increases the number of aggregate wagers, this reduces the volatility via the central limit theorem. In short, size and volume matter. The greater the number of wagers made, the less variance one will see in the aggregate outcome of those wagers. Finally, since the gaming industry is so tightly regulated, the chances of being defrauded are remote as all casino operators are thoroughly vetted via a strict licensing regimen and their underlying gaming operations must meet minimum standards set by the various state gaming regulators.

Offering a gross gaming revenue insurance product is beneficial for both casino operators and insurers. The insurer will generate premium revenues in excess of their loss claims and the casino operator will gladly pay those insurance premiums so they can reduce their gross gaming revenue volatility. By buying insurance, the casino operator may locked in a known return (based on their player database, aggregate odds, game rules and bet volume generated by the qualified patrons), or at least a known range of returns, in exchange for a premium paid to gaming insurance system. This insurance contract eliminates, or at least reduces volatility in the casino operator's expected return in exchange for a slightly lower guaranteed return. It also allows the operator to remove table game bet limits which are often assigned to tables and games which were put into place to remove volatility under non-insured operations. The system can mitigate risk as it can reduce overall volatility by insuring across a broad spectrum of casino operators and players. In this case, since these are all uncorrelated risks, the more wagers insured the closer the outcomes come to expected or theoretical return.

FIG. 1 shows an example system for managing operator risk. For instance, there may be two or more unaffiliated gaming locations 100 (e.g., casinos, racinos, or other gaming location type) whose risk may be managed so that a more consistent (and predictable) revenue may be achieved for the gaming locations by the use of insurance. For instance, risk may be mitigated among several independent gaming locations (e.g., gaming locations A-C (items 101A-101C)). Indeed, one advantage that is provided by such a system is that independent locations may mitigate their risk which is spread to other unaffiliated locations through the use of insurance. This is beneficial, as smaller gaming entities need not mitigate their risk by diversifying their game types or increasing the number of locations in order to be self-insuring.

For instance, a single location operator would benefit by having a consistent return by an insurance entity that mitigates risk across multiple independent properties. The single location operator would be capable of ensuring a consistent income that avoids volatility in income.

To this end, existing systems at the gaming location may be modified to provide information to an insurer network 102. This information may be used to assess the risk of a particular gaming location and to determine a guaranteed revenue stream and its associated insurance cost. As discussed above, it would be desirable for a gaming location to achieve a consistent level of revenue, and to do so, the gaming location would be willing to give up a certain amount as income paid to the insurer. Thus, for a particular revenue level, and based on a profile of the gaming location (e.g., the volatility of the income, volatility in the wins/losses by their players, types of games and odds, etc.), an amount of insurance cost may be determined.

According to one embodiment, information used to determine insurance rates may be obtained from gaming location systems including, but not limited to, casino/patron management systems (e.g., system 103), player tracking systems, online systems, and third party information systems (e.g., credit reporting bureaus). Game playing systems (e.g., systems A-Z (items 104A-104Z)) or any other system that provides information about the gaming location, its games, or the players that has an affect on gaming location income may be utilized to gather information for use by the insurer network and/or casino management system 103. Other examples of systems and methods that may be used to collect and evaluate a casino's or player's information is contained in U.S. application Ser. No. 12/345,289 entitled SYSTEM AND METHOD FOR COLLECTING AND USING PLAYER INFORMATION, filed Dec. 29, 2008, which is incorporated by reference herein by its entirety and forms an integral part of the specification.

In yet another embodiment, it is appreciated that the players themselves have an affect on the income of a particular gaming location. For instance, it is appreciated that "whales" or bettors that wager a proportionately large amount in relation to other bettors, can have a significant affect on the bottom line income of a gaming location. In one example, approximately 50% of a gaming location's income may be derived from 5% of the players. So, if those players are successful, are unsuccessful, default in paying losses, etc., their actions will significantly affect the income of the gaming location.

In one embodiment, because it is appreciated that players have such an effect, information related to the gaming location players may be used to determine volatility in gaming location income at any particular point in time. Thus, in one embodiment, information collected on such players (e.g., by a casino/patron management system, online systems, third party systems, etc.) may be used to determine the risk of loss that the gaming location is exposed to, and determine the gaming location's insurance cost in order to maintain their minimum level of income. Information collected about players that could be used may include, for example, frequency of visitation, games played, house advantage for those games played, bet size, duration of play, pace of play, amount wagered, win history, credit rating, or other information collected about the player.

To this end, one or more insurer systems may be provided that collect and model information about the gaming locations and their players that may be used to calculate expected returns and volatility of returns based on any one or more of the factors discussed herein which may affect the returns for a casino. The return and volatility (risk) models may be constructed using, for example, an analysis of historical returns for a casino or other gaming facility under various conditions of the one or more of the factors discussed herein which may affect the returns for a casino.

Figure 2:
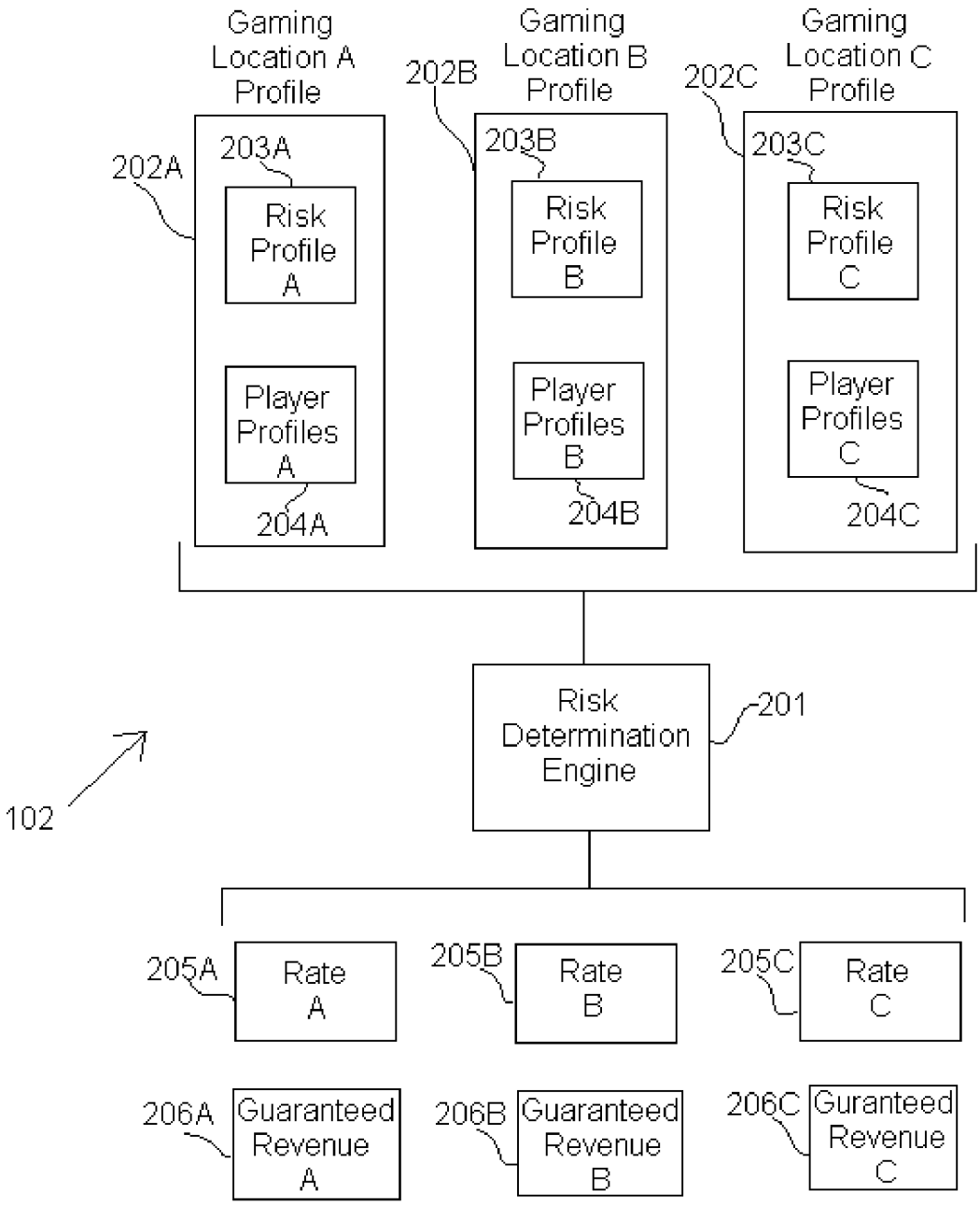
FIG. 2 is a block diagram of an insurer network in accordance with an aspect of the present invention.

For instance, an insurer network 102 may include one or more systems (e.g., risk determination engine 201 of FIG. 2) that evaluate one or more parameters relating to the gaming location and its players. In one example, a system may maintain one or more profiles for one or more gaming locations. As shown in FIG. 2, a system may maintain a gaming and/or risk profile for various gaming locations for which insurance rates need to be determined. For instance, the system may maintain a profile for each gaming location, such as location A gaming profile (item 202A) associated with gaming location A (item 101A of FIG. 1). Similarly, the system may maintain other profiles (e.g., profiles B, C (items 202B, 202C) associated with their respective gaming locations (101B, 101C, respectively). The gaming and/or risk profiles 202A-202C could be calculated by the risk determination engine 201 based at least in part upon risk profiles, e.g. risk profiles 203A-203C associated with player profiles 204A-204C of players playing at the respective gaming locations 202A-202C. The risk profiles 203A-203C could in some embodiments be generated based in part upon factors such as affluence of a player and/or expected game play (e.g., including such factors as frequency of game play, types of games played, and amounts of wagers per game played) which may be included in the associated player profiles 204A-204C using, for example, a historical analysis of how such factors affected gaming returns and the volatility of gaming returns in the past. It should be understood that multiple player profiles 204A-204C and/or risk profiles 203A-203C could be associated with one or more gaming locations 101A-101C and these multiple player profiles 204A-204C and risk profiles 203A-203C could be utilized to form a composite risk profile 202A-202C for each gaming location. In some embodiments, the risk determination engine 201, or a computer system associated with the insurer network would perform calculations to establish a composite risk profile for a gaming location based at least in part on the player profiles and the associated risk profiles of players playing at the gaming location.

In one embodiment, risk determination engine 201 may use one or more parameters to determine an insurance rate (e.g., rates A-C (items 205A-205C)) associated with each respective gaming location. Such rates may also be determined as a function of a guaranteed revenue rate (e.g., rates A-C (items 206A-206C)). Such guaranteed revenue rates may be determined or otherwise provided by the respective gaming location, as their desired guaranteed revenue. This desired guaranteed revenue need not coincide with the gaming location's expected revue, but rather may be set at a higher or lower level than an expected revenue that may be calculated from historical averages or otherwise. A range of revenues may also be provided.

Figure 3:
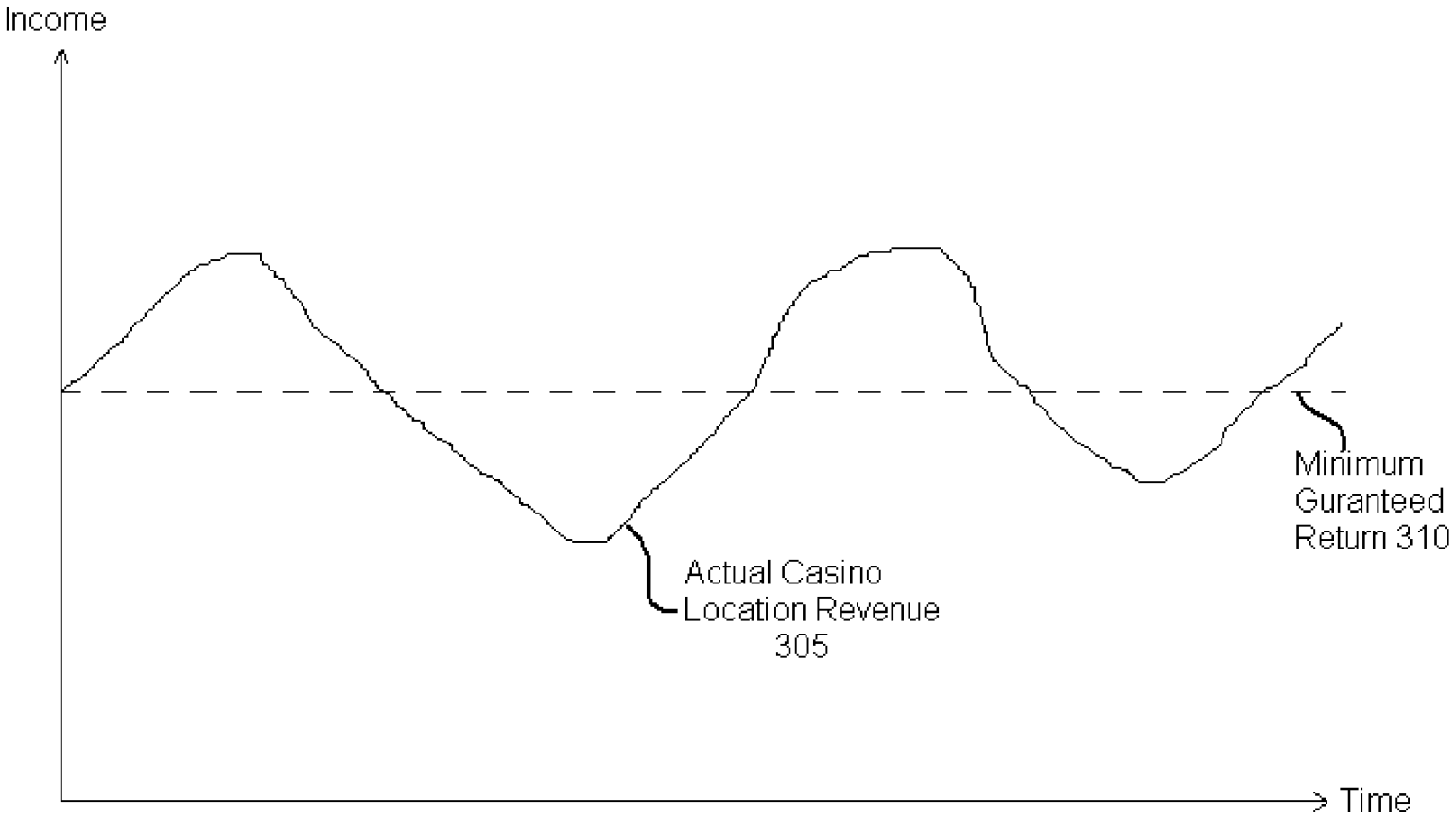
FIG. 3 is a chart illustrating a minimum guaranteed return to a casino versus the casino's actual revenue in accordance with an aspect of the present invention.

As qualitatively shown in FIG. 3, a minimum guaranteed return (e.g., revenue) may be determined such that the casino operator will be paid this minimum amount regardless of the actual casino location revenue. As shown, the actual casino revenue 305 may fluctuate dramatically, and may be higher or lower than the minimum return 310. In one example, money paid to the insurer may be a fixed amount. However, for situations where actual revenue exceeds a certain amount, the insurer may partake in a portion of this upside (e.g., proportionally to the amount of the upside, or other function of the amount). In this way, the insured (e.g., the casino location) may achieve a steady guaranteed income level while at the same time mitigating their losses.

The expected revenue of a casino may vary according to certain periods of time (e.g., days of the week, according to seasons, to particular holiday vs. non-holiday time periods, or other period). For example, there is typically more game play performed in casinos on weekends rather than weekdays, and thus a casino may be expected to earn more on weekends than weekdays. Similarly, there may be a greater amount of game play performed on holiday weekends than non-holiday weekends, or during traditional vacation months. Also, the types of games played at a particular location or the demographic of the types of players that play at a particular location may vary over time. Thus, a minimum guaranteed return or a premium required to insure a particular minimum return may be determined in part by the time period for which the casino may be purchasing insurance. In some embodiments, a guaranteed return may be held constant for different time periods while the premium a casino may be paid for this guaranteed return varies according to factors including the time period for which insurance is purchased.

The expected revenue of a casino may also vary according to the weather. For example, casino guests may be more inclined to remain inside and gamble during periods of inclement weather. Accordingly, a minimum guaranteed return or a premium required to insure a particular minimum return may be determined in part by the forecasted weather in the vicinity of the casino, which may be provided, for example by a data feed from one or more third party providers of weather information.

Another factor that may influence the profitability of a casino is the demographics and makeup of its clientele. For example, if the number of wealthy patrons frequenting a casino who might typically gamble more than less affluent players decreases, the profits of the casino may be expected to decline. In particular, if one or more of the "whales" that are typically loyal to a particular casino either decide to go to another casino, or for some other reason no longer are expected to return to a casino, the casinos profits may be expected to decrease. In some instances the "whales" or other affluent players may be older than less affluent players or players that gamble less. Accordingly, a minimum guaranteed return or a premium required to insure a particular minimum return may be determined in part by mortality rates and obituaries, and in some embodiments by the number of identified "whales" that die during any specified time period. Similarly, data regarding the average wealth of casino patrons may be monitored, for example by examining the credit ratings of casino guests, and a minimum guaranteed return or a premium required to insure a particular minimum return may be adjusted based in part upon the wealth level of the population of casino guests or attendees.

In some embodiments, a casino may purchase revenue insurance for a short time period, such as a return for a particular day. In other embodiments, the casino may purchase insurance covering a longer time period, for example the return over a year, a month, a week, or any other time period. If the insurer is insuring a casino's return for a particular time period, the amount of guaranteed return or the premium required for a particular guaranteed return may be calculated by analyzing data such as average return and standard deviation of return for a casino for similar time periods in the past. For example, if a casino was insuring returns for Thanksgiving weekend, the returns and standard deviation of returns for the casino and/or other like casinos during previous Thanksgiving weekends might be analyzed in order to calculate a particular insurance premium for a particular guaranteed return.

In some embodiments, a particular insurance premium for a particular guaranteed return might be calculated dynamically by analyzing the performance of the casino in a time period prior to the time period being insured. For example, if in the past, a casino generated revenues on Fridays that were on average X % higher than revenues on the Thursday immediately preceding the Friday, the revenue of the casino for a Thursday could be used to determine an insurance premium for a particular guaranteed return should the casino wish to insure its returns for a Friday. Similarly, returns for a holiday week or a particular month could be analyzed and compared against similar time periods in the past and other time periods preceding these similar time periods in the past to be used to determine an insurance premium for a particular guaranteed return.

In some embodiments an insurer would not provide a casino with a particular guaranteed return, but rather would make up for only a portion of losses above a certain threshold. This threshold could be compared against an expected variance and expected average in the casinos returns for the time period being insured to calculate an appropriate premium.

In some embodiments, the insurer could insure a particular profit margin for a given time period rather than insure a given return. An expected profit margin and variance in profit margin would then be utilized in the calculation of a particular premium to insure a particular profit margin. An expected profit margin and variance in profit margin could be calculated in similar manners as expected return and variance in return.

In some embodiments, the type of games in a casino may be a factor in setting an insurance premium for a particular guaranteed return. For example, if a casino had slot machine games which had low average returns for the players but a very high jackpot that was infrequently achieved, this casino might have a higher variability in return than other casinos which might have slot machine games with lower jackpots but higher average returns to the players. In other embodiments, the premium for a particular guaranteed return could be calculated in part by determining which games were being played in a casino. Increased play of games which had a higher variability of return, e.g. slot machines with high jackpots, might result in a higher premium charged for a particular guaranteed level or rate of return for the casino.

In all methods described above, statistical measures such as median or mode of returns could be utilized instead of average returns. Similarly, statistical distributions other than Gaussian distributions could be used to calculate standard deviation or variability of returns. In addition, in some embodiments, an average return used to set an insurance premium for given return guarantee may be calculated on a rolling basis, either weighted or unweighted, for example, an average return could be calculated as $R=(5(R_{t-1})+4(R_{t-2})+3(R_{t-3})+2(R_{t-4})+(R_{t-5}))/15$ wherein R is the average return used in the premium calculation, $R_{t-1}$ is the return in the immediately previous time period, $R_{t-2}$ is the return in the time period immediately preceding time period t−1, etc. Other methods of calculating a rolling average, such as utilizing an exponentially weighted rolling average or a straight rolling average, or other methods of calculating rolling averages known in the statistical arts could be utilized.

Factors such as overall casino profitability during the time period in question may also be taken into account. For example, insurance premiums and/or insurance payments for particular casino returns could be adjusted if the economy was in a boom period when many people were gambling and the casino was making a large average return versus if the economy was in a lull when few people were gambling and the casino was making a lesser (or even negative) average return.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A method for accessing and analyzing one or more qualified casino player records over an electronic medium comprising:

securely logging into one or more casino management systems;

extracting patron information from the one or more casino management systems to a remote system for analysis;

analyzing, using a computer, patron play behavior and modeling the patron play behavior against known games, odds and rules sets; and predicting a theoretical gross gaming revenue for each of the patrons and for casino operators associated with the one or more casino management systems for a specified period of time.

2. The method of claim 1, wherein the casino player records are associated with patrons who are members of a gambling loyalty program and/or are tracked by a casino/patron management system.

3. The method of claim 1, wherein the patron information includes at least one of frequency of visitation, games played, house advantage for those games played, bet size, duration of play, and pace of game play.

4. The method of claim 3, wherein the patron information is augmented by information from third party databases including, information from credit scoring agencies, to provide a more complex picture of each patron.

5. The method of claim 1, further comprising offering a casino operator an insurance contract guaranteeing a minimum return.

6. The method of claim 5, wherein terms of the insurance contract are based at least in part upon theoretical gross gaming revenue for qualified patrons at a casino.

7. The method of claim 6, wherein the theoretical gross gaming revenue is calculated in part based upon an expected play volume for the qualified patrons.

8. The method of claim 6, further comprising collecting premium fees from the casino operator and compensating the casino operator for valid claims against their insurance contract.

9. An insurance system for insuring casino operators against improbably gaming outcomes comprising:

a computerized casino management system adapted to gather information related to game play within a casino;

an insurance system interface adapted to receive a request for a level of profitability insurance for a given time period in which the casino is operating;

a network configured to transmit information from the casino management system to an insurer network;

a risk determination engine included within the insurer network and configured to calculate statistics related to an expected profit return of the casino; and a premium calculation engine adapted to calculate a premium for the level of profitability and time period requested, based at least in part from the information transmitted from the casino management system.

10. A method for insuring casino operators against improbably gaming outcomes comprising:

gathering information related to a game play within a casino on a computerized casino management system;

entering a request for a level of profitability insurance for a given time period in which the casino is operating into an insurance system interface;

transmitting information from the casino management system to an insurer network;

transmitting information from the insurance system interface to the insurer network;

calculating statistics relating to an expected profit return of the casino on risk determination engine included within the insurer network; and calculating a premium for the level of profitability and time period requested, based at least in part from the information transmitted from the casino management system on a premium calculation engine.

11. The method of claim 10, further comprising communicating a calculated insurance premium to the casino.

12. The method of claim 11, further comprising accepting payment of the insurance premium through a payment interface coupled to the insurer network.

13. The method of claim 10, further comprising transferring funds to the casino under the condition that the casino does not attain a level of profitability during the given time period requested in the request for a level of profitability insurance.

* * * * *